US010559903B2

(12) United States Patent
Jiang et al.

(10) Patent No.: US 10,559,903 B2
(45) Date of Patent: Feb. 11, 2020

(54) CARD EDGE CONNECTOR EQUIPPED WITH SOLDER BALLS ON CONTACTS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yu Jiang, Kunshan (CN); Zhuang-Xing Li, Kunshan (CN); Wen-Jun Tang, Kunshan (CN); Xue-Wu Bu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/503,425

(22) Filed: Jul. 3, 2019

(65) Prior Publication Data

US 2020/0014136 A1 Jan. 9, 2020

(30) Foreign Application Priority Data

Jul. 3, 2018 (CN) ..... 2018 1 0717668
Jul. 3, 2018 (CN) ..... 2018 1 0717678
(Continued)

(51) Int. Cl.
*H01R 12/73* (2011.01)
*H01R 12/57* (2011.01)
*H01R 13/428* (2006.01)

(52) U.S. Cl.
CPC ..... *H01R 12/737* (2013.01); *H01R 12/57* (2013.01); *H01R 13/428* (2013.01)

(58) Field of Classification Search
CPC .. H01R 13/64; H01R 13/629; H01R 13/5025; H01R 13/62; H01R 12/7076; H01R 4/66
See application file for complete search history.

(56) References Cited

U.S. PATENT DOCUMENTS 5,478,259 A * 12/1995 Noschese ..... H01R 13/658 439/607.31
5,688,147 A * 11/1997 Coteus ..... H01R 12/7005 439/633
(Continued)

FOREIGN PATENT DOCUMENTS

CN 201638992 U 11/2010

*Primary Examiner* — Abdullah A Riyami
*Assistant Examiner* — Nader J Alhawamdeh
(74) *Attorney, Agent, or Firm* — Wei Te Chung; Ming Chieh Chang

(57) ABSTRACT

A card edge connector includes an insulative elongated housing, two rows of contacts disposed in the housing. The housing includes a pair of side walls extending along the longitudinal direction with a receiving slot therebetween in a transverse direction perpendicular to the longitudinal direction. The receiving slot is configured to receive a card type memory module. Each contact is equipped with the solder ball for surface mounting upon the printed circuit board. The contact includes a retaining section secured to the housing, a deflectable contacting section extending upwardly from the retaining section, and a tail section extending downwardly from the retaining section and including a connecting section and a solder pad. The solder pads of the contacts in a same row along the longitudinal direction are alternately arranged in opposite directions in the transverse direction perpendicular to the longitudinal direction.

20 Claims, 12 Drawing Sheets

(30) Foreign Application Priority Data

Jul. 3, 2018 (CN) ..... 2018 1 0720336
Jul. 3, 2018 (CN) ..... 2018 2 1047222 U
Jul. 3, 2018 (CN) ..... 2018 2 1047225 U

(56) References Cited

U.S. PATENT DOCUMENTS 5,842,880 A * 12/1998 Pei ..... H01R 12/7005 439/327
5,957,708 A * 9/1999 Lin ..... H01R 12/7005 439/157
6,093,046 A * 7/2000 Chiou ..... H01R 12/7005 439/378
6,322,388 B1 * 11/2001 Akio ..... H01R 13/5812 439/459
6,663,402 B1 * 12/2003 Yu ..... H01R 13/6582 439/108
6,672,887 B1 * 1/2004 Yu ..... H01R 13/6582 439/108
6,695,630 B1 * 2/2004 Ku ..... H05K 7/1431 439/152
6,821,149 B2 * 11/2004 Lai ..... H01R 23/6873 439/607.31
7,108,554 B2 * 9/2006 Huang ..... H01R 23/6873 439/378
7,207,815 B1 * 4/2007 Ju ..... H01R 12/7029 439/159
7,442,093 B2 * 10/2008 Li ..... H01R 12/721 439/633
7,491,092 B2 * 2/2009 Zhu ..... H01R 13/6456 439/633
7,771,232 B2 * 8/2010 Si ..... H01R 13/658 439/607.01
8,038,459 B2 * 10/2011 Hayauchi ..... H01R 13/5213 439/301
8,092,239 B2 * 1/2012 Nishiyama ..... H01R 12/7005 439/157
8,794,988 B2 * 8/2014 Tanaka ..... H01R 12/83 439/326
2005/0277334 A1 * 12/2005 Huang ..... H01R 23/6873 439/607.01
2007/0254526 A1 * 11/2007 Lai ..... H05K 1/18 439/637
2010/0323549 A1 * 12/2010 Hayauchi ..... H01R 13/5213 439/357
2012/0135618 A1 * 5/2012 Shen ..... H01R 12/721 439/152
2013/0084723 A1 * 4/2013 Shen ..... H01R 12/7029 439/159
2013/0095679 A1 * 4/2013 Li ..... H01R 12/7005 439/157
2015/0318627 A1 * 11/2015 Berry, Jr. ..... H01R 12/7076 714/6.32
2016/0020539 A1 * 1/2016 Li ..... H01R 12/707 439/155
2016/0020540 A1 * 1/2016 Shen ..... G06F 1/203 439/155

* cited by examiner

CARD EDGE CONNECTOR EQUIPPED WITH SOLDER BALLS ON CONTACTS

BACKGROUND OF THE INVENTION

1. Field of the Invention

The invention relates to the electrical connector, particularly to the electrical connector equipped with the solder balls on the contact tails in a dense arrangement.

2. Description of Related Art

China Patent No. CN201638992 discloses a card edge connector for receiving a card type memory module wherein the solder pads formed on the tails of the contacts are closely neighbored with one another, thus tending to result in crosstalk therebetween to jeopardize the communication in high frequency.

It is desired to have the electrical connector having the solder balls on the solder pads of the contact tails in a appropriate dense arrangement to be fit for the high frequency communication.

SUMMARY OF THE INVENTION

A card edge connector includes an insulative elongated housing, two rows of contacts disposed in the housing. The housing includes a pair of side walls extending along the longitudinal direction with a receiving slot therebetween in a transverse direction perpendicular to the longitudinal direction. The receiving slot is configured to receive a card type memory module. Each contact is equipped with the solder ball for surface mounting upon the printed circuit board. The contact includes a retaining section secured to the housing, a deflectable contacting section extending upwardly from the retaining section, and a tail section extending downwardly from the retaining section and including a connecting section and a solder pad. The solder pads of the contacts in a same row along the longitudinal direction are alternately arranged in opposite directions in the transverse direction perpendicular to the longitudinal direction. In the paired contacts in the transverse direction, the corresponding solder pads are spaced from each other with a constant distance in the transverse direction optimally, thus avoiding the significant crosstalk therebetween. A centerline of the solder pad along the transverse direction is either aligned with the corresponding retaining section in the transverse direction or offset from the corresponding retaining section in the longitudinal direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
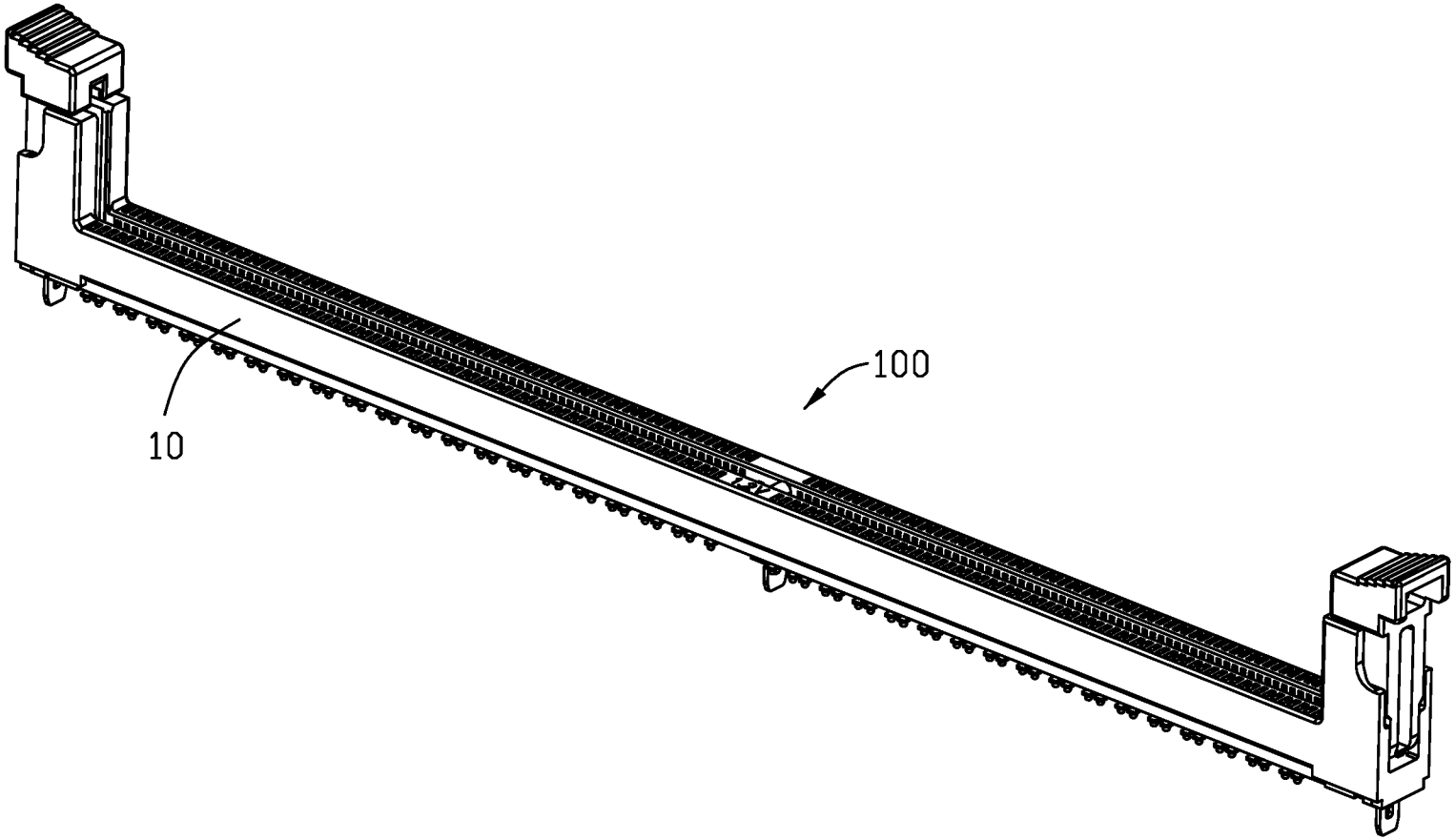
FIG. 1 is a perspective view of an electrical connector according to a first embodiment of the invention.
Figure 2:
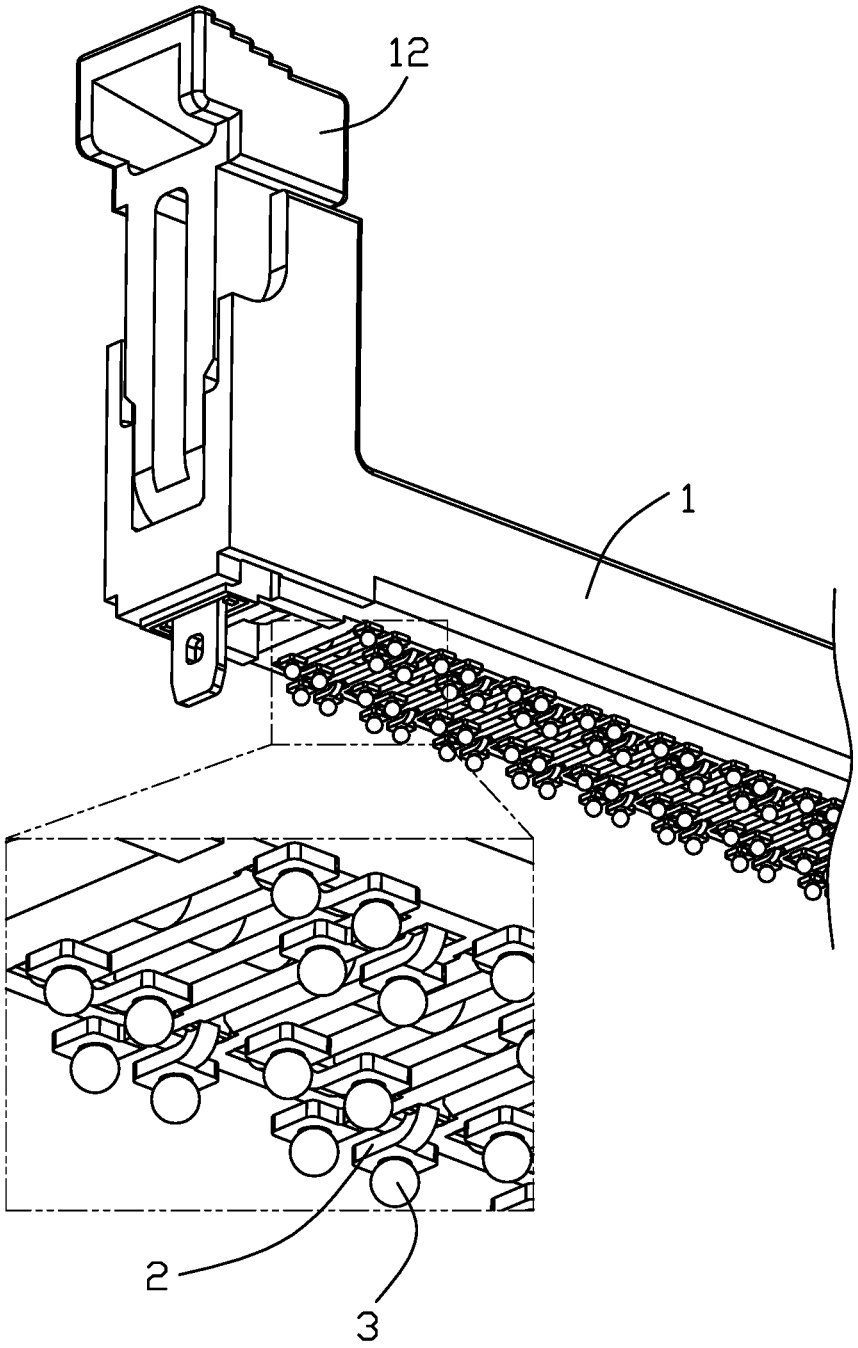
FIG. 2 is another perspective view of a portion of the electrical connector of FIG. 1.

Referring to FIGS. 1-5, an card edge type electrical connector 100 includes an insulative elongated housing 1, two rows of contacts 2 retained in the housing 10. The housing 10 includes a pair of elongated side walls 10 extending along the longitudinal direction, and a receiving slot 11, for receiving the card type memory module (not shown), formed between the pair of side walls 10 in the transverse direction perpendicular to the longitudinal direction. The contact 2 includes a retaining section 21 secured to the housing 1, the resilient contacting section 22 extending from an upper section of the retaining section 21 and into the receiving slot 11, and a tail section 23 extending downwardly from the lower section of the retaining section 21. The tail section 23 includes a connecting section 24 linked to the retaining section 21, and a horizontal solder pad 25. A dimension of the solder pad 25 is larger than that of the connecting section 24 and that of the retaining section 21 in the longitudinal direction. Notably, the centerline X1, X3 of the solder pad 25 is not aligned, along the transverse direction, with the centerline X2 of the connecting section 24 or that of the retaining section 21 but in an offset manner in the longitudinal direction. Understandably, such an offset arrangement is to satisfy the two requirements of which one is that the dimension of the solder pad 25 should be relatively larger than that of either the connecting section 24 or the retaining section 21 for supporting the solder ball, and the other is that the neighboring solder pads could not be too close to each other for lessening the crosstalk therebetween.

In details, the solder pads 25 include the outward/first solder pad 26 extending outwardly to be exposed to the exterior in the vertical direction perpendicular to both the longitudinal direction and the transverse direction, and the inward/second solder pad 27 extending inwardly to be hidden under the housing 1. The outward solder pads 26 and the inward solder pads 27 are alternately arranged with each other along the longitudinal direction. In this embodiment, in the same row the outward solder pads 26 are paired and the inward solder pads 27 are also paired for such alternate arrangement. Notably, in this embodiment, the distance between centerlines X1 and X3 of the two/paired neighboring solder pads 25 in the same row, is 1.25 mm, thus avoiding the improper crosstalk therebetween. +

In brief, on one hand because either the paired outward solder pads 26 or the paired inward solder pads 27 extend away from each other in the longitudinal direction, the distance A between the centerlines X1, X3 of the two neighboring contacts 2 in the same row, is larger that that between two centerlines X2 of the neighboring contacts 2. On the other hand, the neighboring outward solder pad 26 and inward solder pad 27 in the same row are also spaced from each other with a distance in the transverse direction for avoiding improper crosstalk therebetween, even though the neighboring outward solder pad 26 and inward solder pad 27 essentially extend toward each other in the longitudinal direction so as to have the distance between the centerlines of the neighboring outward solder pad 26 and inward solder pad 27 smaller than that between the centerlines of the corresponding connecting sections 24 of the same contacts 2. Therefore, the arrangement of the neighboring solder pads may avoid the improper crosstalk in the electrical connector having the fine pitch arranged contacts 2. Notably, in this arrangement, the neighboring outward solder pad 26 and inward solder pad 27 are partially overlapped in the transverse direction. Also, in this embodiment, for the paired contacts 2 in the transverse direction, of which one belonging to one row of the contacts 2 has the inward solder pad 26 and the other belong to the other row of the contacts 2 has the outward solder pad 27 so as to keep a distance from each other for avoid improper crosstalk therebetween.

Figure 3:
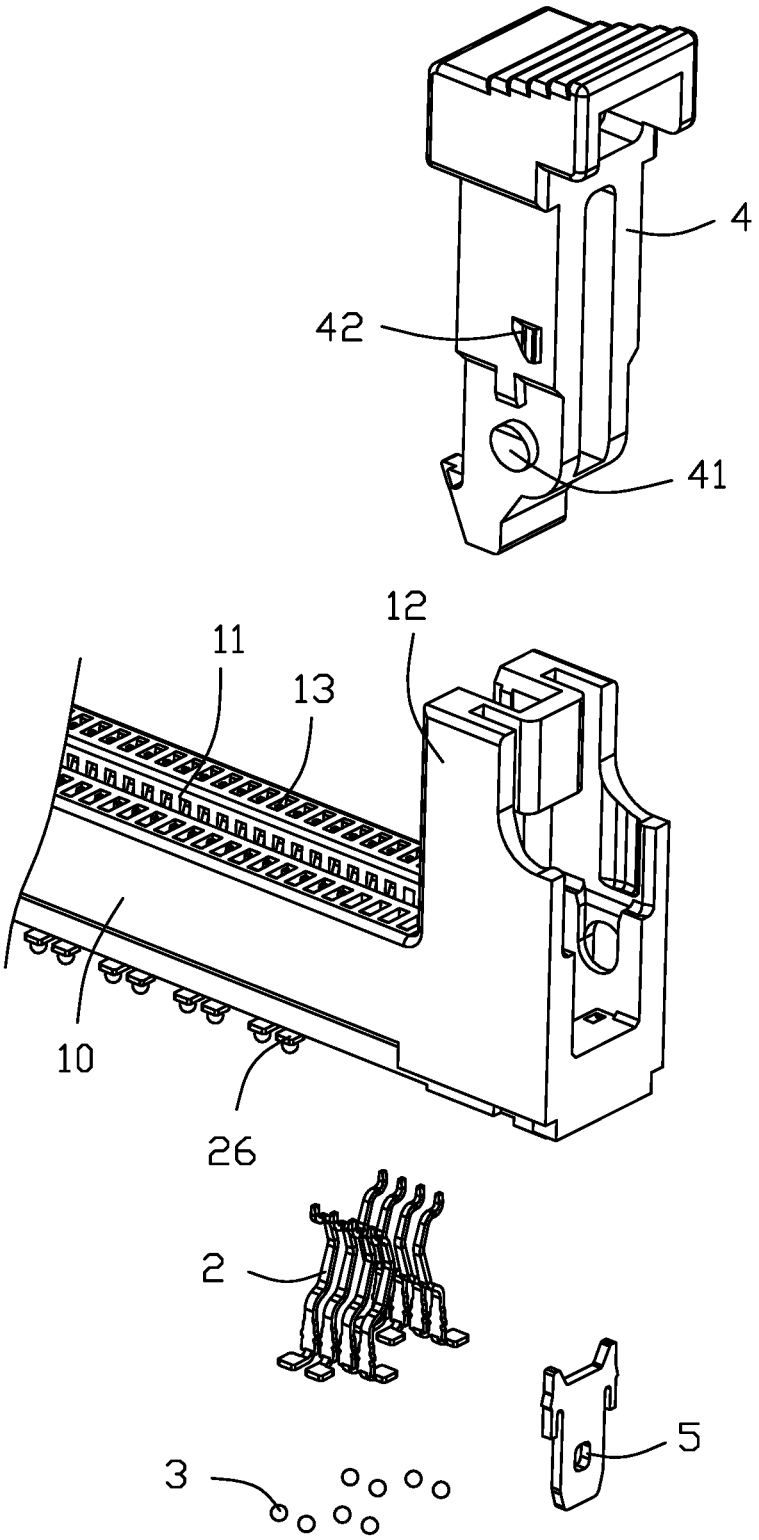
FIG. 3 is an exploded perspective view of the portion of the electrical connector of FIG. 2.
Figure 4:
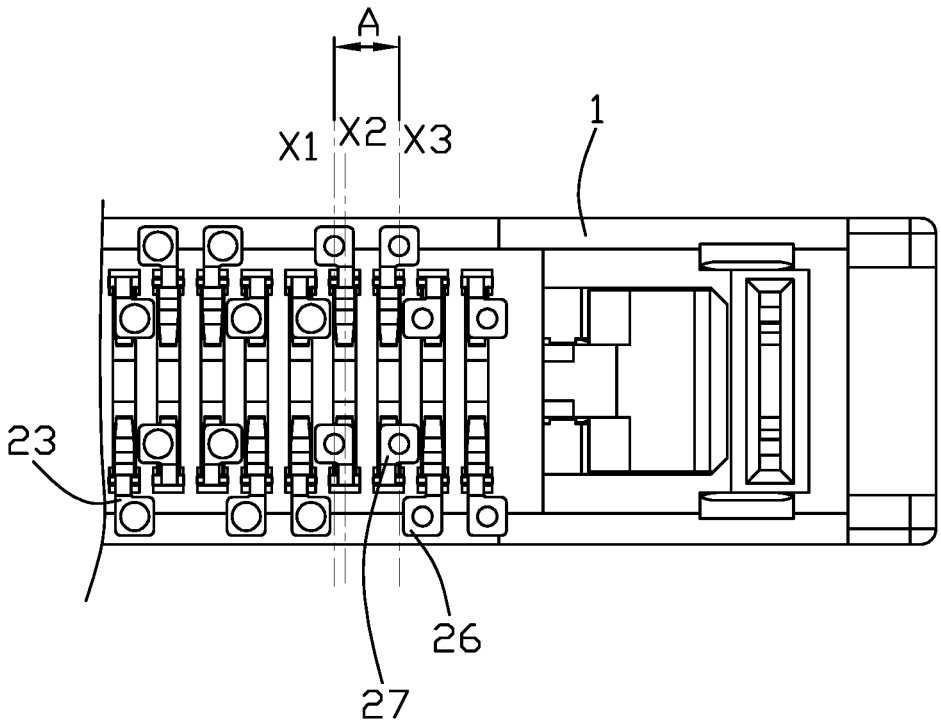
FIG. 4 is a bottom view of the portion of the electrical connector of FIG. 3.
Figure 5:
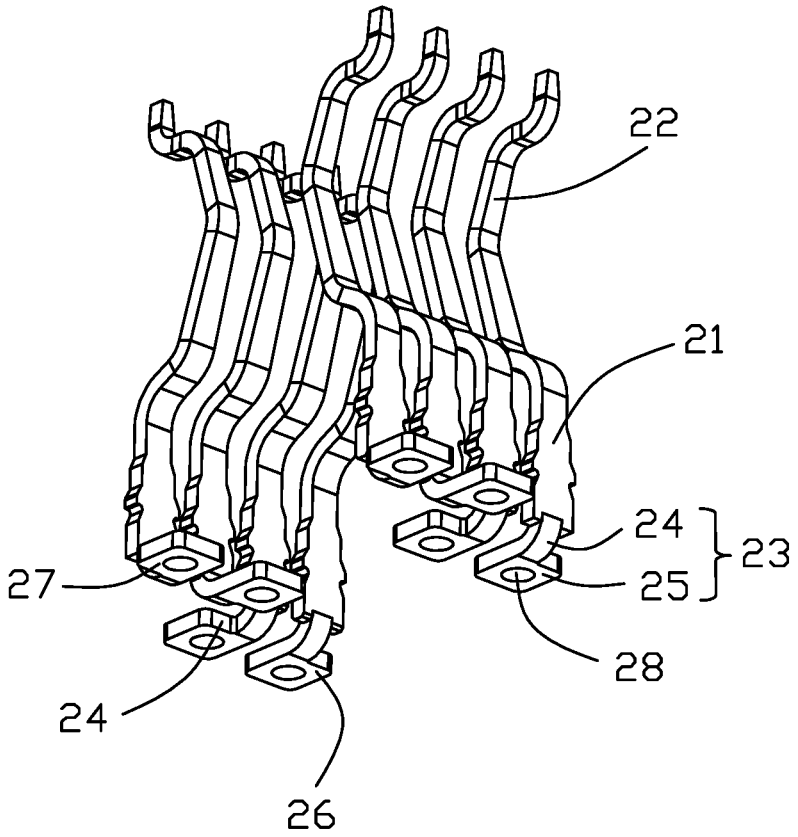
FIG. 5 is a perspective view of the contacts of the electrical connector of FIG. 3.

As shown in FIGS. 3 and 5, the solder balls 3 are attached to the corresponding solder pads 25. To receive and hold the solder ball 3, the solder pad 25 forms a recess 28. The retaining section 21 forms barbs (not labeled) for retention consideration. The side wall 10 forms passageways 13 to receive the corresponding contacts 2, respectively. The housing 1 forms a pair of towers 12 at two opposite ends thereof along the longitudinal direction. A pair of rotatable ejectors 4 are mounted on the towers 12, respectively. Each ejector 4 has a pair of pivotal shafts 41 to be received within corresponding recesses (not labeled) in the tower 12 for rotation, and a pair of protrusions 42 to be engaged within the corresponding grooves (not labeled) in the tower 12 for retention. A board lock 5 is located under each tower 12.

Figure 6:
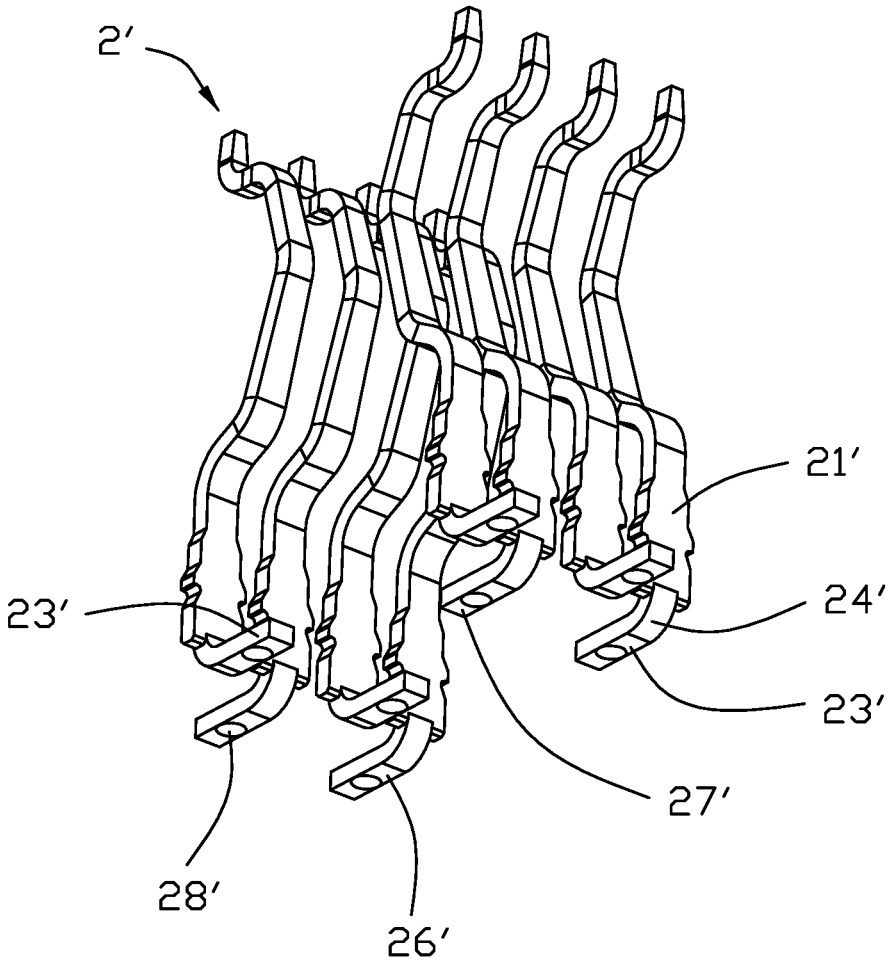
FIG. 6 is a perspective view of the contacts of the electrical connector according to a second embodiment of the invention.
Figure 7:
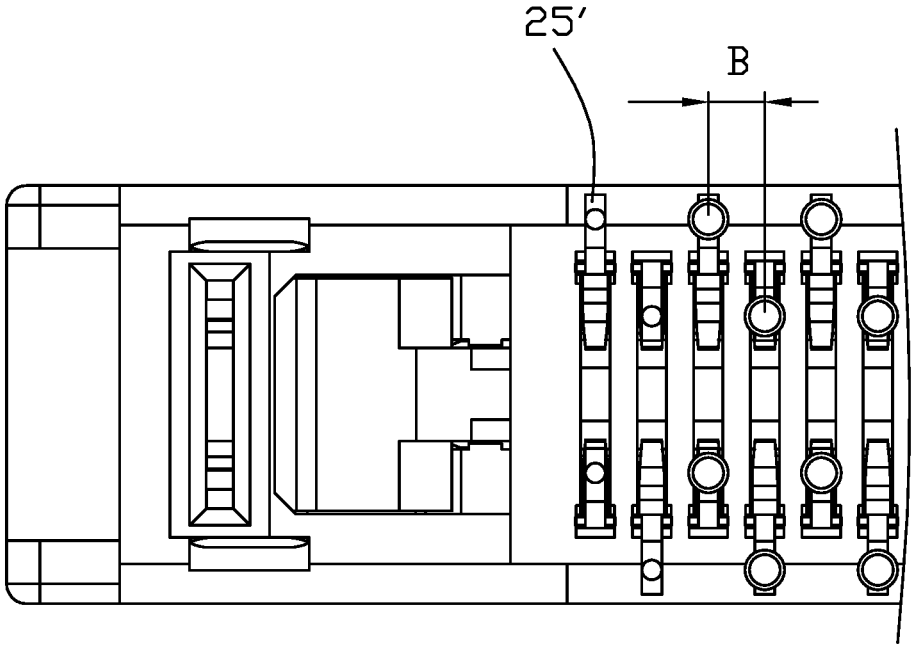
FIG. 7 is a bottom view of a portion of the electrical connector of FIG. 6.
Figure 8:
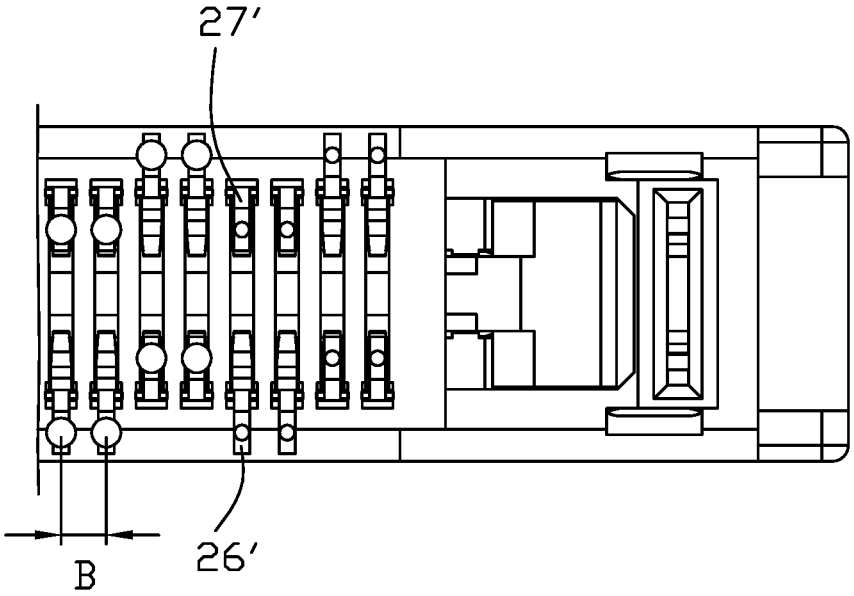
FIG. 8 is a bottom view of a portion of the electrical connector according to a third embodiment of the invention.

FIGS. 6-12 illustrate different embodiments with the same basic structure except the solder pad arrangement. Referring to FIGS. 6 and 7, in the second embodiment, the contact 2' has the corresponding tail section 23' including the connecting section 24' and the solder pad 25'. The width of the connecting section 24' is equal to that of the solder pad 25'. The distance B between the centerline of the neighboring solder pad 25' is 0.85 mm Understandably, because there is no offset arrangement along the longitudinal direction for the neighboring solder pads 25, those solder pads 25 are preferred to be alternately arranged with one another instead of with pairs so as to keep the optimal distance between every adjacent two solder pads 25 disregarding the outward solder pads 26 or the inward solder pads 27. Anyhow, FIG. 8 shows the third embodiment wherein the neighboring solder pads 25 are paired similar to the first embodiment.

Figure 9:
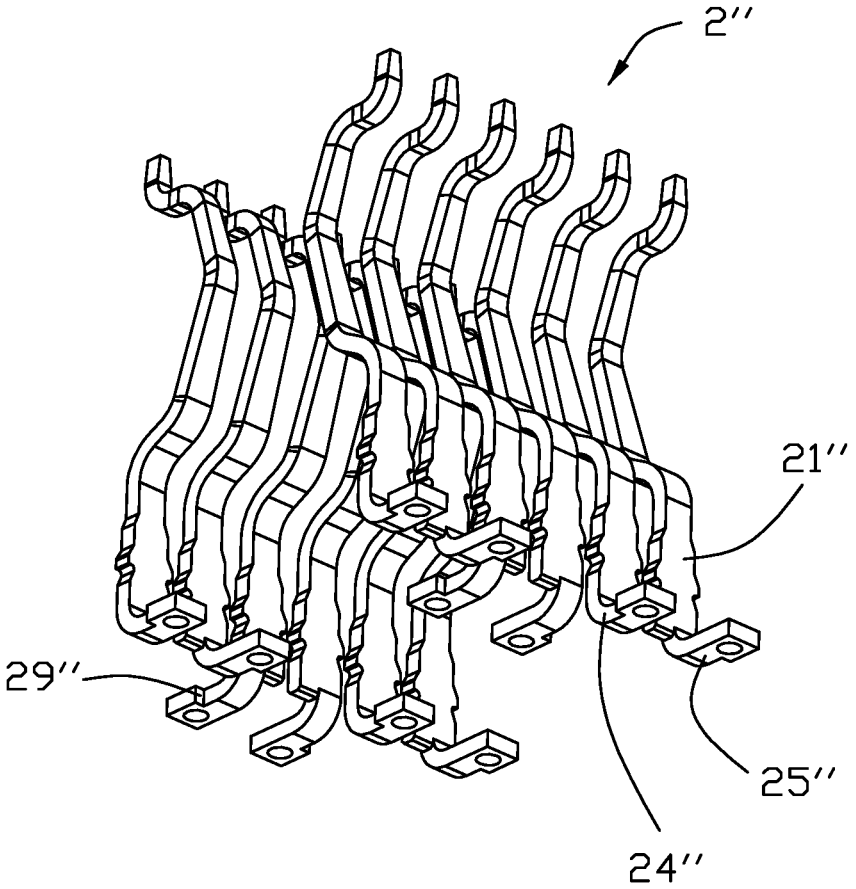
FIG. 9 is a perspective view of the contacts of the electrical connector according to a fourth embodiment of the invention.
Figure 10:
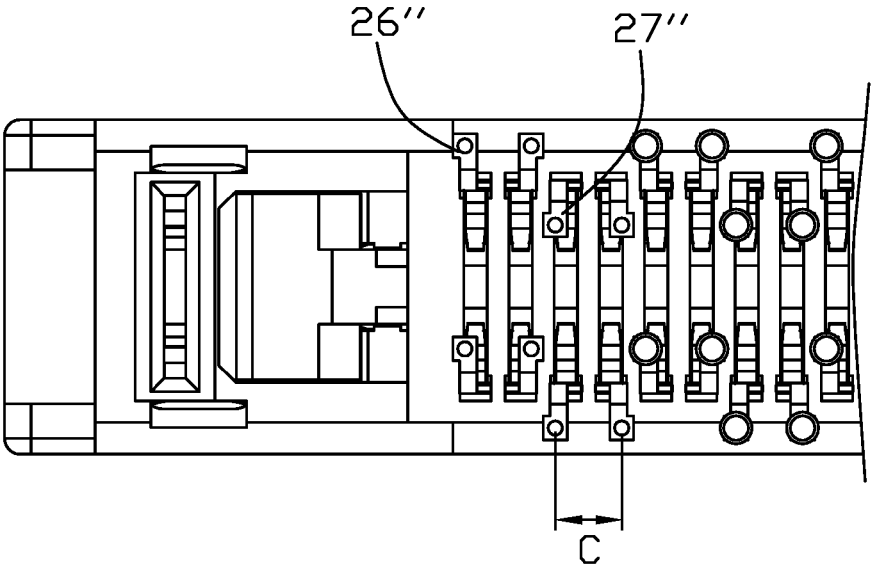
FIG. 10 is a bottom view of a portion of the electrical connector of FIG. 9.

FIGS. 9 and 10 show the fourth embodiment wherein the centerline of the connecting section 24" is offset from the centerline of the retaining section 21", and such offset is mutually outwardly away from each other in the neighboring paired contacts 2 for increasing the distance therebetween. Similarly, in the neighboring paired contacts 2", the corresponding solder pads 25" form the widened sections 29" which are also away from each other in the longitudinal direction for increasing the distance therebetween. As a result, the distance C between the centerlines of the paired solder pads 25", either the outward solder pads 26" or the inward solder pads 27", is 1.25 mm. Compared with the first embodiment, the fourth embodiment is to have the connecting section 24" offset from the retaining section 21" while the first embodiment is to have the connecting section 24 aligned with the retaining section 21.

Figure 11:
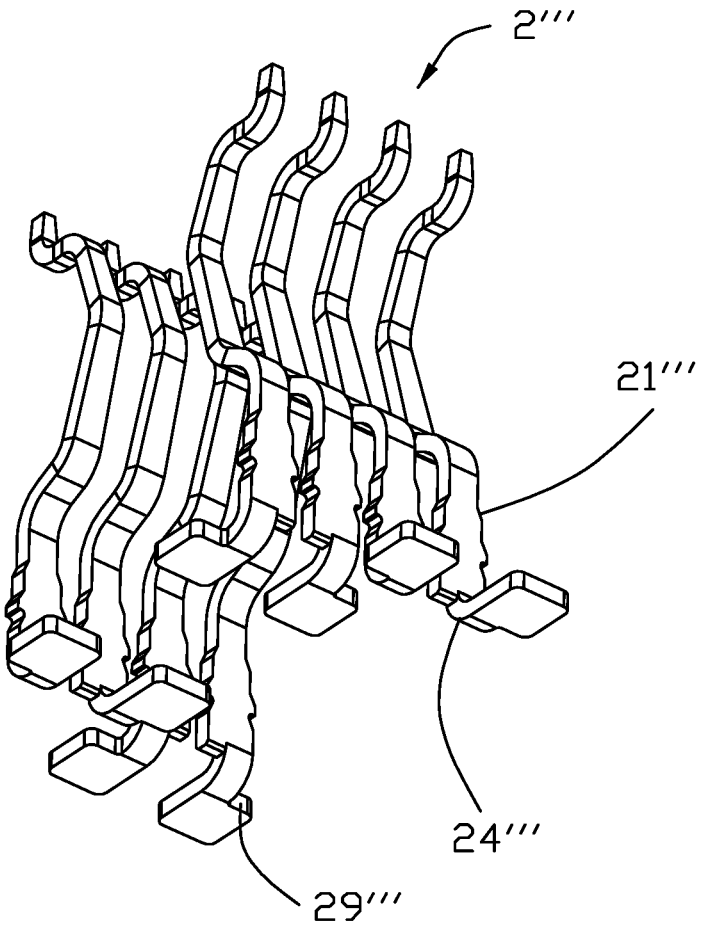
FIG. 11 is a perspective of the contacts of the electrical connector according to a fifth embodiment of the invention.
Figure 12:
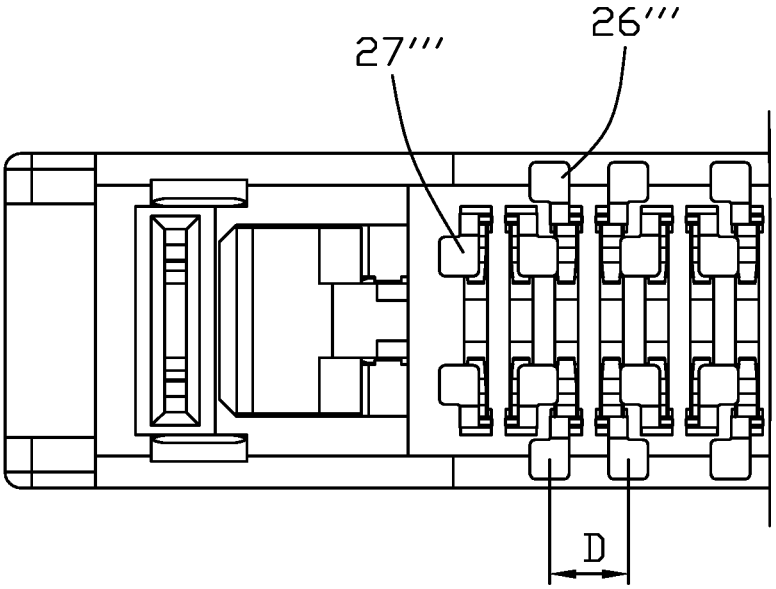
FIG. 12 is a bottom view of a portion of the electrical connector of FIG. 11.

FIGS. 11-12 show the fifth embodiment which is similar to the fourth embodiment except that the two contacts 2' aligned with each other in the transverse direction have the corresponding solder pads either both the inward solder pads 26' or both the outward solder pads 27'. In contrast, in all aforementioned other four embodiments, the paired contacts aligned with each other in the transverse direction, have the corresponding solder pads, i.e., one inward solder pad and one outward solder pad, extend toward along the same transverse direction while in the fifth embodiment, the paired contacts aligned with each other in the transverse direction, have the corresponding solder pads either extending toward each other or away from each other in the transverse direction. It is also noted that similar to those in the first embodiment, in the fifth embodiment, the neighboring inward solder pad 26' and outer solder pad 27" are also partially overlapped with each other in the transverse direction. In the fifth embodiment, the distance D between two neighboring inward solder pads or between two neighboring outward solder pads along the longitudinal direction is 1.48 mm.

In conclusion, all five embodiments disclose the solder pad arrangement for the fine pitch contact connector without improper crosstalk therebetween. Notably, the retaining sections of the contacts in the same row are located on corresponding outer sides of the corresponding passageways, and the corresponding solder pads are alternately arranged in a staggered manner so as to increase the distance between the neighboring solder pads for lessening the crosstalk. It is also noted that the centerline of the retaining section is also essentially the centerline of the corresponding passageway receiving the contact. In other words, the spirit of the some embodiments of the invention is to have the distance between the centerlines of the solder pads of the paired neighboring contacts larger than the pitch of the passageways in the longitudinal direction. It can be noted that some embodiments of the invention use the paired solder pads which are both either the outward solder pads or the inward solder pads so as to form the paired solder pads alternately arranged with one another in a staggered manner along the longitudinal direction, compared with the traditional designs using the individual solder pads alternately arranged with one another in the staggered manner along the longitudinal direction. This is because some contacts are of differential pair contacts which are preferred to coupled with each other side by side in a balanced or symmetrical manner. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector for receiving a memory module, comprising:

an insulative elongated housing having a pair of elongated side walls extending along a longitudinal direction with a receiving slot formed therebetween in a transverse direction perpendicular to the longitudinal direction;

two rows of the passageways formed in the corresponding side walls, respectively;

two rows of contacts retained in the pair of side walls, respectively, and having corresponding contacting regions exposed in the receiving slot; and each of said contacts including a retaining section retained in the corresponding passageway, a resilient contacting section extending upwardly from the retaining section and into the receiving slot, and a tail section extending downwardly from the retaining section and including a connecting section linked to the retaining section and a horizontal solder pad at a bottom, the solder pads being categorized with inward solder pads extending toward the receiving slot, and outward solder pads extending away from the receiving slot; wherein the contacts in a same row are paired for every two neighboring contacts so as to form a plurality of pairs, each pair have either the corresponding inward solder pads or the corresponding outward solder pads, and the pairs having the corresponding inward solder pads and the pairs having the corresponding outward solder pads are alternately arranged with each other in a staggered manner along the longitudinal direction; wherein in each pair, a distance between centerlines of the solder pads is larger than that between centerlines of the retaining sections.

2. The electrical connector as claimed in claim 1, wherein a dimension of the solder pad is larger than that of the connecting section in the longitudinal direction.

3. The electrical connector as claimed in claim 1, wherein each of said solder pad has a widened section which extends along the longitudinal direction only on one side thereof.

4. The electrical connector as claimed in claim 1, wherein in each pair, a distance between centerlines of the connecting sections and larger than that between the centerlines of the retaining sections in the longitudinal direction.

5. The electrical connector as claimed in claim 1, wherein the contacts aligned with each other in the transverse direction, have the corresponding solder pads of which one is the inward solder pad and the other is the outward solder pad.

6. The electrical connector as claimed in claim 1, wherein the contacts aligned with each other in the transverse direction, have the corresponding solder pads both being either the inward solder pads or the outward solder pads.

7. The electrical connector as claimed in claim 1, wherein the neighboring inward solder pad and outward solder pad are partially overlapped with each other in the transverse direction.

8. The electrical connector as claimed in claim 1, wherein each of said solder pads is equipped with a solder ball.

9. The electrical connector as claimed in claim 1, wherein the contacting aligned with each other in the transverse direction, have the corresponding solder pads aligned with each other in the transverse direction.

10. An electrical connector for receiving a memory module, comprising:

an insulative elongated housing having a pair of elongated side walls extending along a longitudinal direction with a receiving slot formed therebetween in a transverse direction perpendicular to the longitudinal direction;

two rows of the passageways formed in the corresponding side walls, respectively;

two rows of contacts retained in the pair of side walls, respectively, and having corresponding contacting regions exposed in the receiving slot; and each of said contacts including a retaining section retained in the corresponding passageway, a resilient contacting section extending upwardly from the retaining section and into the receiving slot, and a tail section extending downwardly from the retaining section and including a connecting section linked to the retaining section and a horizontal solder pad at a bottom, the solder pads being categorized with inward solder pads extending toward the receiving slot, and outward solder pads extending away from the receiving slot; wherein the contacts in a same row are paired for every two neighboring contacts so as to form a plurality of pairs, each pair have either the corresponding inward solder pads or the corresponding outward solder pads, and the pairs having the corresponding inward solder pads and the pairs having the corresponding outward solder pads are alternately arranged with each other in a staggered manner along the longitudinal direction; wherein in each pair, a distance between centerlines of the solder pads is larger than a pitch of the passageways along the longitudinal direction.

11. The electrical connector as claimed in claim 10, wherein a dimension of the solder pad is larger than that of the connecting section in the longitudinal direction.

12. The electrical connector as claimed in claim 10, wherein each of said solder pad has a widened section which extends along the longitudinal direction only on one side thereof.

13. The electrical connector as claimed in claim 10, wherein in each pair, a distance between centerlines of the connecting sections and larger than that between the centerlines of the retaining sections in the longitudinal direction.

14. The electrical connector as claimed in claim 10, wherein the contacts aligned with each other in the transverse direction, have the corresponding solder pads of which one is the inward solder pad and the other is the outward solder pad.

15. The electrical connector as claimed in claim 10, wherein the contacts aligned with each other in the transverse direction, have the corresponding solder pads both being either the inward solder pads or the outward solder pads.

16. The electrical connector as claimed in claim 10, wherein the neighboring inward solder pad and outward solder pad are partially overlapped with each other in the transverse direction.

17. The electrical connector as claimed in claim 10, wherein each of said solder pads is equipped with a solder ball.

18. The electrical connector as claimed in claim 10, wherein the contacting aligned with each other in the transverse direction, have the corresponding solder pads aligned with each other in the transverse direction.

19. An electrical connector for receiving a card type memory module, comprising:

an insulative elongated housing having a pair of elongated side walls extending along a longitudinal direction with a receiving slot formed therebetween in a transverse direction perpendicular to the longitudinal direction;

two rows of the passageways formed in the corresponding side walls, respectively;

two rows of contacts retained in the pair of side walls, respectively, and having corresponding contacting regions exposed in the receiving slot; and each of said contacts including a retaining section retained in the corresponding passageway, a resilient contacting section extending upwardly from the retaining section and into the receiving slot, and a tail section extending downwardly from the retaining section and including a connecting section linked to the retaining section and a horizontal solder pad at a bottom; wherein the contacts in a same row are paired for every two neighboring contacts so as to form a plurality of pairs, each pair have either the corresponding inward solder pads or the corresponding outward solder pads, and the pairs having the corresponding inward solder pads and the pairs having the corresponding outward solder pads are alternately arranged with each other in a staggered manner along the longitudinal direction;

each of said solder pads is equipped with a solder ball thereunder.

20. The electrical connector as claimed in claim 19, wherein a diameter of the solder ball or the solder pad is larger than a width of the corresponding passageway in the longitudinal direction.

* * * * *